US007531736B2

(12) United States Patent
Honeywell

(10) Patent No.: US 7,531,736 B2
(45) **Date of Patent: *May 12, 2009**

(54) SYSTEM AND METHOD FOR ADJUSTING MIDI VOLUME LEVELS BASED ON RESPONSE TO THE CHARACTERISTICS OF AN ANALOG SIGNAL

(75) Inventor: David Honeywell, Lincoln, CA (US)

(73) Assignee: Burgett, Inc., Sacramento, CA (US)

( * ) Notice: Subject to any disclaimer, the term of this patent is extended or adjusted under 35 U.S.C. 154(b) by 451 days.

This patent is subject to a terminal disclaimer.

(21) Appl. No.: 11/241,240

(22) Filed: Sep. 30, 2005

(65) Prior Publication Data

US 2007/0074622 A1 Apr. 5, 2007

(51) Int. Cl.
*G10H 7/00* (2006.01)

(52) U.S. Cl. ..... 84/645; 84/600

(58) Field of Classification Search ..... None
See application file for complete search history.

(56) References Cited

U.S. PATENT DOCUMENTS 4,913,026 A 4/1990 Kaneko et al.
4,953,039 A 8/1990 Ploch
5,033,352 A 7/1991 Kellogg et al.
5,237,125 A 8/1993 Fields
5,612,943 A 3/1997 Moses
5,821,444 A 10/1998 Yamaura
5,905,220 A 5/1999 Lee et al.
6,069,310 A 5/2000 James
6,111,174 A 8/2000 Oba et al.
6,118,065 A 9/2000 Haruyama
6,160,213 A 12/2000 Arnold et al.
2001/0010187 A1 8/2001 Ishii
2002/0108484 A1 8/2002 Arnold et al.
2002/0133248 A1 9/2002 Fay et al.
2003/0131717 A1 7/2003 Shiiya
2003/0172798 A1* 9/2003 Fujiwara et al. ..... 84/609
2003/0177889 A1 9/2003 Koseki et al.
2003/0196539 A1* 10/2003 Koseki et al. ..... 84/604
2003/0196540 A1* 10/2003 Ishii ..... 84/617
2004/0206226 A1* 10/2004 Negoescu et al. ..... 84/600
2006/0000343 A1* 1/2006 Koseki et al. ..... 84/604
2008/0178726 A1* 7/2008 Honeywell

* cited by examiner

*Primary Examiner*—Marlon T Fletcher
(74) *Attorney, Agent, or Firm*—John P. O'Banion

(57) ABSTRACT

An apparatus and method of controlling note velocity within an electronically controlled player piano in response to the analog characteristics (level, strength, amplitude, etc.) of a received audio signal encoded with a MIDI (or similar) note stream. The invention allows conventional audio playback devices to be utilized as a source for MIDI information which drives the actuation of the keys of the player piano.

47 Claims, 5 Drawing Sheets

SYSTEM AND METHOD FOR ADJUSTING MIDI VOLUME LEVELS BASED ON RESPONSE TO THE CHARACTERISTICS OF AN ANALOG SIGNAL

CROSS-REFERENCE TO RELATED APPLICATIONS

Not Applicable

STATEMENT REGARDING FEDERALLY SPONSORED RESEARCH OR DEVELOPMENT

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND OF THE INVENTION

1. Field of the Invention

This invention pertains generally to player mechanisms for acoustic instruments, and more particularly to controlling playback characteristics of a digital MIDI based instrument.

2. Description of Related Art

Acoustic instruments having electronics which allow them to be played autonomously, such as what is often referred to as "player pianos", typically have a dedicated control unit which receives data from a data storage unit, which is often integrated into the control unit, for controlling the notes and characteristics. The data is normally encoded in the musical instrument digital interface (MIDI) protocol which encodes a series of note signals, velocities, and optionally other information. The control unit stores important playback characteristics and provides output which is often adapted for the specific piano (or other acoustic instrument) being played. It will be appreciated that all specific characteristics of the device are handled by the traditional control unit. For example, one of the main functions of the player-specific control unit is to allow the user to adjust the playback volume of the piano.

Control units are coupled to actuator electronics in the acoustic instrument for controlling actuators during playback. One form of control unit communicates with the actuator electronics in the instrument using proprietary hardware interfaces, wherein only a specific controller from that manufacturer is compatible with the instrument.

Alternatively, the control unit may modify the incoming MIDI stream and output another digital data stream for use by the actuator electronics within the instrument. For example, one form of digital data stream sent to the instrument is generated by having the control unit modify or augment MIDI stream for sending to the actuator electronics. However, it should be appreciated that even when the actuator electronics are configured to receive a data stream, such as MIDI, modified MIDI, or augmented MIDI, doing so would circumvent velocity compensation and other adaptations performed by the control unit for improving playback on the particular instrument.

Accordingly a need exists for an apparatus and method for interfacing between a MIDI device and a control unit not having MIDI functionality.

BRIEF SUMMARY OF THE INVENTION

An aspect of the invention is an interface apparatus for communicating between a non-MIDI controller, such as an off-the-shelf media player, and a MIDI compatible instrument. The apparatus comprises a demodulator configured to demodulate a MIDI data stream from an audio signal input from the controller, and a signal monitor configured to measure the amplitude of at least a portion of the audio signal. The apparatus further comprises a processor configured to control a MIDI volume level of the instrument according to the measured amplitude of the incoming audio signal. Controlling the MIDI volume level of the instrument may be achieved by adjusting at least one MIDI velocity in the MIDI data stream, or by injecting a MIDI command (e.g. a channel volume control message or custom system exclusive message).

Generally, the MIDI data stream comprises a plurality of MIDI messages. In one mode of the present aspect, the processor is configured to modify the MIDI messages based on at least one stored parameter.

In one embodiment, the MIDI-compatible instrument may be an electronic piano drive system, wherein the drive system is configured to play notes on a piano according to the modified MIDI messages. Preferably, the interface apparatus is configured to adjust note velocity of the player piano in response to the measured amplitude of the audio signal.

In one embodiment, the audio signal comprises a first channel having a modulated MIDI component and a second channel having an audio component. Preferably, the demodulator and the signal monitor only effect or respond to the first channel.

The signal monitor is generally configured to measure the amplitude of the modulated MIDI component. In a preferred embodiment, the signal monitor comprises a voltage comparator or an A/D.

In another embodiment, the second channel is coupled to a mono-to-pseudo stereo converter to separate the audio component into left and right channels. For example, the audio component may comprise audio accompaniment for a MIDI performance.

In yet another embodiment, the controller comprises a portable media player, wherein the media player is configured to output the audio signal via a line out. Alternatively, the controller may be any device capable of playing audio, such as a stereo CD player, or computer.

In one aspect of the current embodiment, the signal monitor is adapted to measure the signal strength from media player such that an increase in the signal strength from the media player affects a corresponding increase in note velocity of the player piano.

Another aspect of the invention is a method of controlling a MIDI compatible instrument. The method comprises inputting an audio signal comprising a MIDI data stream, monitoring the audio to measure the amplitude of the MIDI data stream, and controlling the MIDI volume of the instrument according to the measured amplitude of the monitored audio signal. Controlling the MIDI volume may be achieved by injecting a MIDI command (e.g. a channel volume control message or custom system exclusive message) into the data stream, or by modifying at least one MIDI velocity in the data stream.

The method may further include demodulating a modulated MIDI data stream. In a preferred mode, the MIDI data stream is monitored and demodulated simultaneously.

Generally, the MIDI data stream comprises a plurality of MIDI messages. At least one of the MIDI messages comprises a MIDI velocity message, wherein in one embodiment the MIDI velocity is modified according to the measured amplitude of the MIDI data stream.

In a preferred embodiment, inputting an audio signal comprises inputting an audio signal from a media player. For example, the audio signal may be inputted from a media player by modulating the MIDI file for audio playback, loading the modulated MIDI file onto the media player, and playing the modulated MIDI file for output via a line out of the media player. The volume on the media player may be increased to increase the amplitude of the MIDI data stream.

In some embodiments, the MIDI file is compressed prior to modulation. Preferably, the MIDI file is compressed as an mp3 file at a bit-rate higher than 192 bit/sec, or other file at an equivalent bit-rate.

The modulated MIDI file may be loaded from a CD onto a CD player, wherein the CD contains the modulated MIDI file. Alternatively, the MIDI file may be loaded as a mp3 onto a mp3 player, wherein playing the modulated MIDI file comprises decompressing the mp3 file for playback via the line out.

In another embodiment, at least a portion of the plurality of MIDI messages are modified according to at least one stored parameter. The MIDI-compatible instrument may be controlled via the modified MIDI messages. Furthermore, the note velocity of the MIDI-compatible instrument may be controlled according to the modified MIDI velocity.

In a preferred embodiment, the MIDI-compatible instrument comprises an electronic piano drive system to play notes on a piano according to the modified MIDI messages.

In another embodiment, the inputted audio signal comprises a first channel having a modulated MIDI component, and a second channel having an audio component. Preferably, only the first channel is the demodulated and monitored. The audio component of the second channel may be converted from mono-to-pseudo stereo, such that the audio component is separated into left and right channels. The audio component may include audio accompaniment, which may be output to a pair of speakers.

Yet another aspect of the invention in an apparatus for modulating note velocity within an electronic player piano in response to received analog signal amplitude. The apparatus includes means for demodulating an audio signal to extract a MIDI data stream, means for monitoring the audio signal to measure the amplitude of at least a portion of the audio signal, and means for adjusting playback note velocity of the player piano in response to the amplitude of the received audio signal. The apparatus may further include means for actuating the keys of a player piano mechanism in response to said extracted MIDI data stream.

Generally, the MIDI data stream comprises a plurality of MIDI messages. In one embodiment the apparatus includes means for storing one or more system parameters, and means for modifying at least one of the plurality of MIDI messages in response to one of the stored system parameters.

In another embodiment, the apparatus comprises means for controlling the audio signal, such as a media player. The media player, e.g. CD player or mp3 player, will have a volume control that adjusts the amplitude of the received audio signal.

The apparatus may further include means for modulating the MIDI data stream prior to playback on said media player, and means for compressing the modulated MIDI data stream prior to playback on said media player. In embodiments where the audio signal comprises a MIDI channel and an audio channel, the demodulating means and the monitoring means only affect the MIDI channel.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

The consumer market is flooded with low-cost, easy-to-use media players, such as portable CD players and MP3 players. Rather than designing a new media player to compete with this market at high cost, the existing market may be leveraged by use of a Piano Interface Device (PID) with translates audio signals to MIDI and vise versa, while at the same time, changing the MIDI velocities based on volume adjustments made by the music player.

Referring more specifically to the drawings, for illustrative purposes the present invention is embodied in the apparatus generally shown in FIG. 1 through FIG. 5. It will be appreciated that the apparatus may vary as to configuration and as to details of the parts, and that the method may vary as to the specific steps and sequence, without departing from the basic concepts as disclosed herein.

Figure 1:
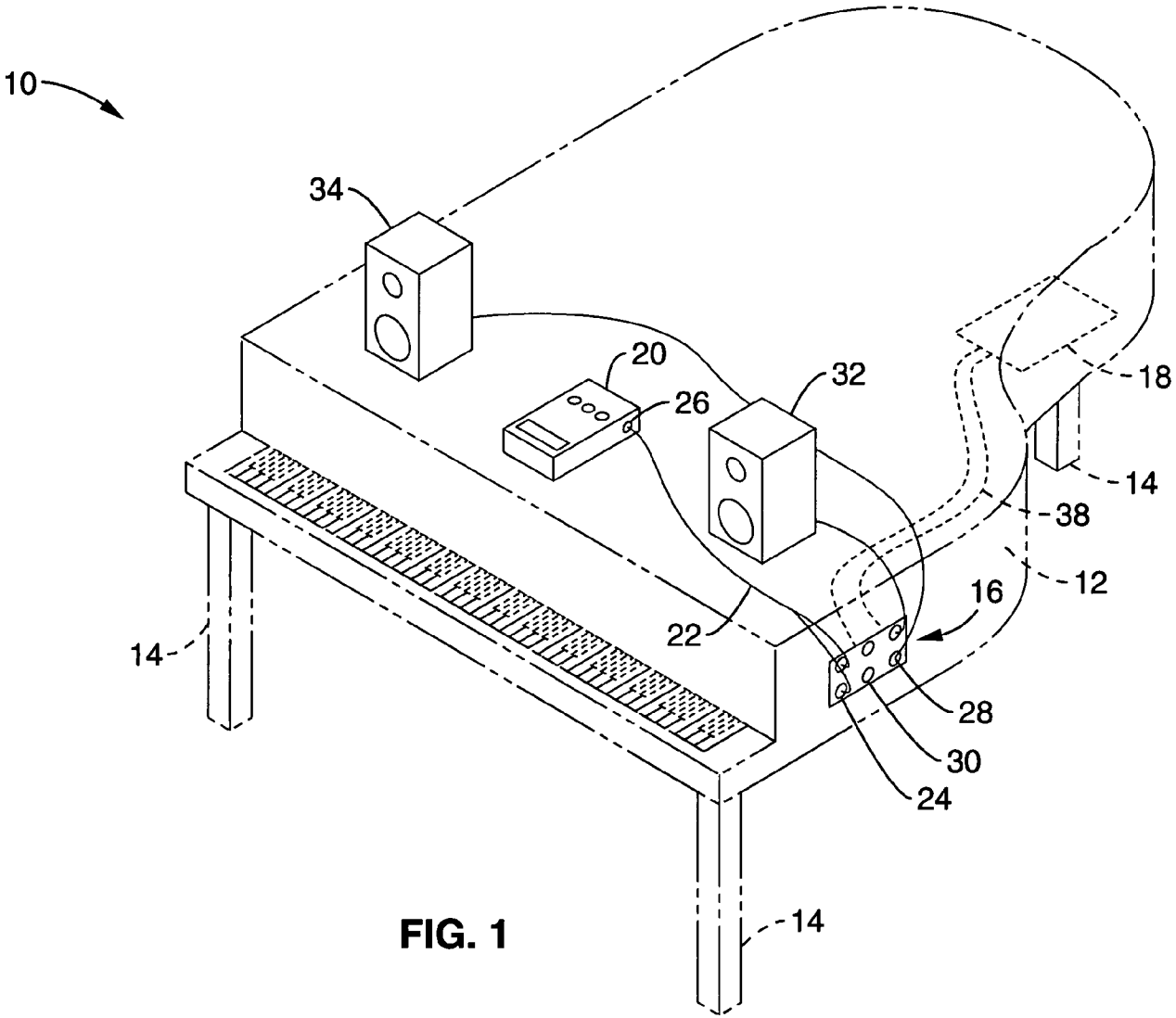
FIG. 1 shows a portable media player interfacing with a Piano Interface Device (PID) installed inside a piano in accordance with the present invention.

Referring initially to FIG. 1, a player piano 10 is shown in accordance with the present invention. The player piano 10 includes a housing 12 supported by plural legs 14. A piano interface device (PID) 18, described in further detail below, is preferably located inside the housing 12. Although the PID 12 may be located external to the piano 10, or attached to an external surface of the piano 10, it is generally aesthetically preferable to have the unit inside the piano.

To allow a controller such as a portable media player 20 to act as a control unit and interface with the PID 18, housing 12 may include an access panel 16 through which the media player 20 can connect to one or more input ports 24 of the PID 18. For example, the output from the media player may have an audio line out 26, which may be plugged into input ports 24 in console 16 via RCA or similar cables 22. Input ports 24 may be routed internally to the PID 18 location by use of internal cables 38.

It is to be understood that the player piano 10 further includes a drive mechanism 76 (FIG. 3) for "playing" the piano. The drive mechanism may be any of those commonly used in the art, but generally comprises high-precision electromagnetic actuators that operate the keys (88 for the typical acoustic piano) and pedals, based on MIDI signals from the PID 18. The PID 18 acts as a "black box" to interface between the media player 20 and the piano drive mechanism. In addition, an optical system (not shown) may be used for detecting how the piano 10 is manually played by a user.

The system may also optionally include audio output ports from the PID 18 for simultaneous playback of music accompaniment out of left and right speakers 32, 34. In addition, if the piano has recording capabilities, MIDI data from the performance may also be output via line out ports 30, and recorded by the media player or other external recording device with such capabilities.

The media player 20 may comprise any number of consumer items commonly available in the industry, such as a CD, DVD, LD, cassette tape, or MP3 player, or even a home computer. These players commonly generally have control functions to drive audio playback, i.e. play, pause, fast forward, rewind, skip etc. In addition, many media or MP3 players will have a user interface with menu options that allows the user to scan a database of songs, and select a particular song, album or playlist. Once a song is chosen for playback, the media player 20 sends a signal to the audio jack or output 26. RCA or similar audio cables 22 then transmit the outputted signal to the input of the PID 18.

Since most off-the-shelf media players do not have integrated MIDI functionality, MIDI data is preferably converted into a format the media player 20 can understand and use. This is because the MIDI file does not contain the sampled audio data, but rather contains only the instructions needed by a midi piano driver, synthesizer, or like instrument, to play the sounds. These instructions are in the form of MIDI messages, which instruct the MIDI device which sounds to use, which notes to play, and how loud to play each note. The actual sounds are then generated by the MIDI instrument.

The MIDI data stream may be a unidirectional asynchronous bit stream at 31.25 Kbits/sec. with 10 bits transmitted per byte (a start bit, 8 data bits, and one stop bit). There are a number of different types of MIDI messages.

The bulk of the performance transmission will occur through Channel Messages that are used to send musical performance information. Typical messages that are used in piano driver system include the Note On, Note Off, Velocity and Pedal On/Off messages. Additional messages may include: Polyphonic Key Pressure, Channel Pressure, Pitch Bend Change, Program Change, and the Control Change (SysEx) messages.

In MIDI systems, the activation of a particular note and the release of the same note are considered as two separate events. The Note On status byte is followed by two data bytes, which specify key number (indicating which key was pressed) and velocity (how hard the key was pressed).

The key number is used in the receiving synthesizer to select which note should be played, and the velocity is normally used to control the amplitude of the note. When the key is released, the keyboard instrument or controller will send a Note Off message. The Note Off message also includes data bytes for the key number and for the velocity with which the key was released. The Note Off velocity information is normally ignored.

Figure 2:
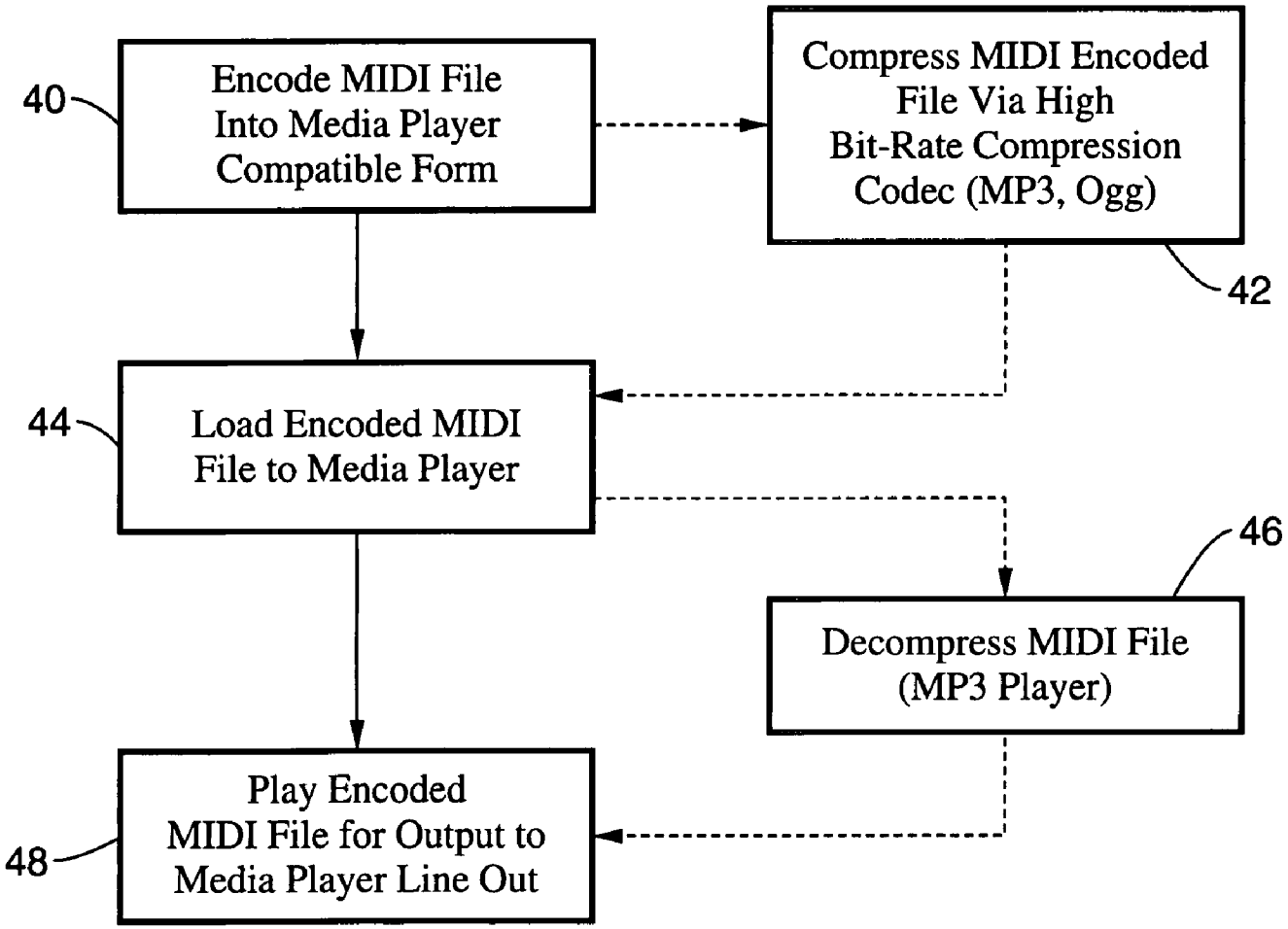
FIG. 2 is a flow diagram of a MIDI file preparation process for playback by a media player.

Referring to FIG. 2, the MIDI data must first be encoded or modulated (step 60) to make the MIDI data readable by an off-the-shelf media player, Existing data modulation techniques, such as those described in U.S. Pat. No. 4,953,039, incorporated herein by reference in its entirety, may be used to encode the MIDI stream to a format readable by most media players. Alternatively, other encoding techniques such as Frequency Shift Keying (FSK) and Phase Shift Keying (PSK) may be employed. FSK utilizes frequency modulation to transmit digital data, i.e. two different carrier frequencies are used to represent binary zero and binary one. Data encoded by these techniques may be compressed and played back at a wide variety of signal levels (from quiet to loud). Furthermore, the techniques described above can manage and play both Type 0 and Type 1 Standard MIDI Files.

For mp3 playback, the data is further compressed (step 42) with any number of commercially available codecs to a compression format such as MP3, WMA, ACC, Ogg Vorbis, etc. Because the compression process removes data from the original file, the file is preferably compressed at a high bit-rate so that MIDI signal data loss is minimized. Mp3 compression standard bit rates of e.g. 192 bit/sec or higher were found to be sufficient in retaining the integrity of the original MIDI data stream.

Once the music has been encoded, it can be stored on the media player for playback (step 44). The user may then select a particular recording of interest, and play the recording (step 48) having the encoded MIDI file in the same way as would be done on a typical audio file. Regardless of the encoding method used, the audio output signal will be affected by all device commands, including volume. For mp3 players or the like, an additional decoding step 46 is performed to uncompress the encoded file for playback.

Figure 3:
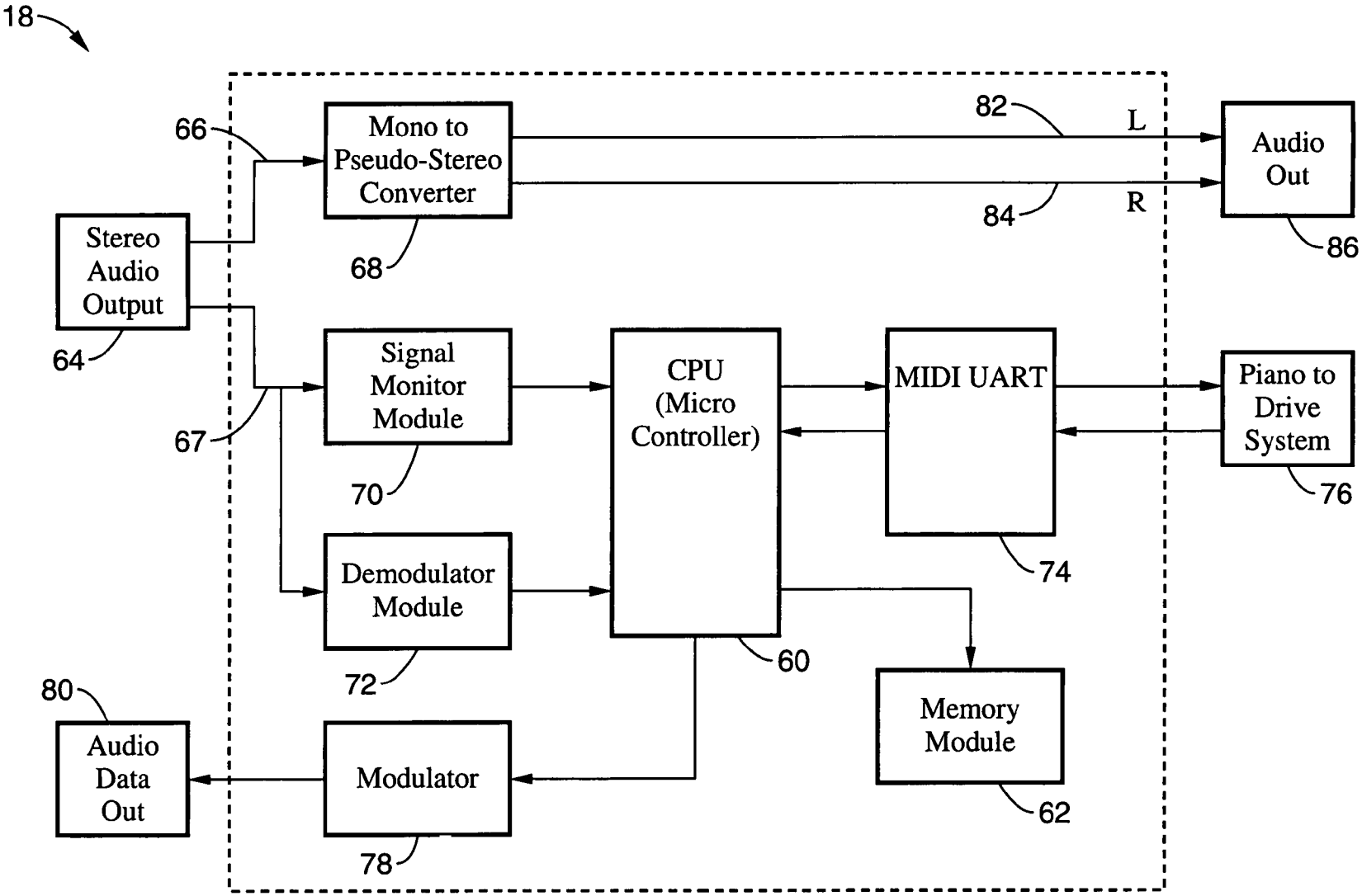
FIG. 3 illustrates a schematic view of a PID in accordance with the present invention.

FIG. 3 illustrates an exemplary PID 18 in accordance with the present invention. The PID 18 includes CPU or microprocessor 60. A memory module 62 may be connected to the microprocessor 60 to provide logic means for the microprocessor. In a preferred embodiment, the logic is stored on a PIC chip, electrically erasable read-only memory (EEPROM) or like technology. Alternatively, the logic of the present invention may be stored on a magnetic tape, hard disk drive, optical storage device, or other appropriate data storage device or transmitting device.

The PID 18 has audio input 64 for at least one audio channel. Preferably, the input comprises two channels, wherein the first channel 67 contains the encoded MIDI data, and the second channel 66 contains audio accompaniment.

The PID 18 also comprises a signal monitor module 70 for use in adjusting MIDI velocities in response to the amplitude of the media player MIDI signal, and a demodulator module 72 which decodes the MIDI data to a readable form. Both the signal monitor module 70 and demodulator module 72 operate on the first channel 67 and output to the CPU 60 for processing.

The signal monitor module 70 generally comprises a voltage comparator or similar device (e.g. A/D) that measures the amplitude of the incoming modulated MIDI signal from the media player.

The CPU 60 is also coupled to a Universal Asynchronous Receiver/Transmitter (UART) 74 for transmission to the piano drive system 76. The PID 18 may also comprise an audio data output 80, and modulator 78 for outputting recorded MIDI data from the piano. If the piano has recording capability, the piano sends recorded MIDI data to the CPU via the UART 74. The CPU 60 formats the data, which is then encoded/modulated by modulator 78 for monaural data audio output. The data output 80 may be connected to a media player's line input to record piano performances (assuming the device has line input functionality).

Referring further to FIG. 3, the second channel 66 containing audio accompaniment data is coupled to a mono-to-pseudo-stereo converter 68, which splits the mono input to a left channel 82 and right channel 84 which connected to audio out 86. The mono to pseudo stereo converter typically converts the mono audio accompaniment input to pseudo-stereo using a filter. For example a shelf filter may be used, in which low frequencies are directed to a first (e.g. left) channel, high frequencies are directed to a second channel. Alternatively, a comb filter may be employed, in which a delayed signal is added to the left channel and subtracted from the right channel. The second channel need not be encoded or decoded, since the media player is compatible with the data without need for further processing.

Figure 4:
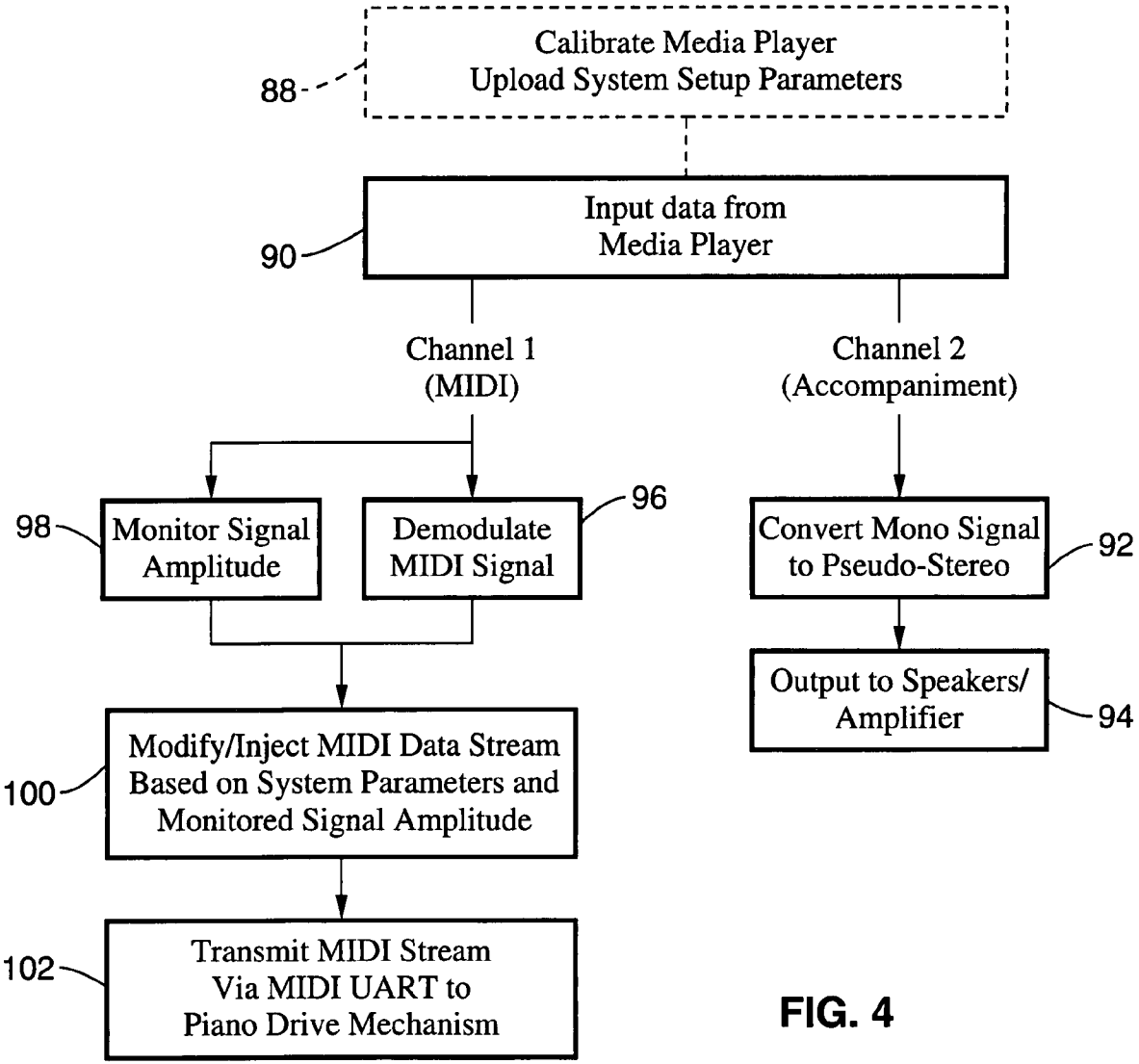
FIG. 4 is a flow diagram illustrating a method of controlling a MIDI compatible instrument using a portable media player.

FIG. 4 illustrates a method of method of controlling a MIDI compatible instrument via a media player in accordance with the present invention. As seen in FIG. 4, the PID processes the first and second channels 67, 66 from the data input step 90 separately and simultaneously. If the audio signal from the media player has audio accompaniment, it is processed to convert the mono signal to pseudo-stereo at step 92. The accompaniment audio stream is thus split into left and right channels and output to speakers at step 94. Alternatively, the pseudo-stereo signal may by output to another audio source such as an amplifier, which then outputs the signal to speakers.

The first channel having the encoded data is simultaneously demodulated (98) and monitored (96) for signal level. These signals are then combined at step 100 where the CPU controls the MID volume level according to the value from the monitored audio signal.

Control of the MIDID volume level may be achieved in a number of ways. In one embodiment, the CPU adjusts MIDI velocities to reflect the incoming signal level, and makes other MIDI adjustments based on the pre-defined system parameters for the particular instrument (piano). Alternatively, a MIDI command message, such as a channel volume control message or custom system exclusive message, may be injected into the data stream to adjust the volume level in response to a change in the media player volume level.

The output from the media player may vary from player, but will generally range from 0V to 1.0V rms, although the method of the present invention may also work on amplified signals as well (e.g. a 40 watt audio signal). The voltage measured from the voltage comparator 70 is processed at the CPU which may access a lookup table to assign a MIDI velocity (or channel volume control message) according to the measured amplitude. For example, the MIDI standard allows for 128 different velocity levels, so each of the 128 MIDI velocities may be assigned a corresponding amplitude measurement. Thus, turning up the volume media player increases the MIDI velocity of subsequent notes. Correspondingly, turning down the volume decreases the MIDI velocity of subsequent notes.

Prior to playback, the system may be calibrated to the media player 20 input in addition to uploading system setup parameters, shown at step 88. Preferably, a setup CD or file (for mp3 player) having a setup software routine is accessed via the media player. For example, the setup routine may allow for determination of the max and min output voltage of the media player by pressing a set button at the lowest and highest volume output levels. In addition, controller code for the "Silent Drive" settings as detailed in U.S. patent application Ser. No. 10/407,869, filed Apr. 3, 2003, such as adjusting the weight of the piano keys, may be input by simply playing a particular track, e.g. "track 15." The Silent Drive CPU board stores all MIDI settings internally via memory module 62. Thus, there is no need for the control unit to store and adjust playback parameters. All settings are controlled by the CPU board, with the media player acting as a storage and playback device.

Because the amplitude of the incoming audio stream is measured separately by the signal monitoring step 98, the demodulated MIDI data from step 96 may be read independently of the shape or amplitude, i.e. the data may be read according to period size by locating the zero-crossings in the signals. Although many compression algorithms may distort the amplitude of the signal, zero-crossings are generally left in tact as long as the bit-rate is high enough. Thus, higher bit-rate compression of the MIDI signal was found to be effective in After the CPU processes the MIDI data based on the system parameters and monitored signal in step 98, the modified MIDI data is transmitted to the piano drive system via the Universal Asynchronous Receiver/Transmitter (UART), shown as step 102.

Figure 5:
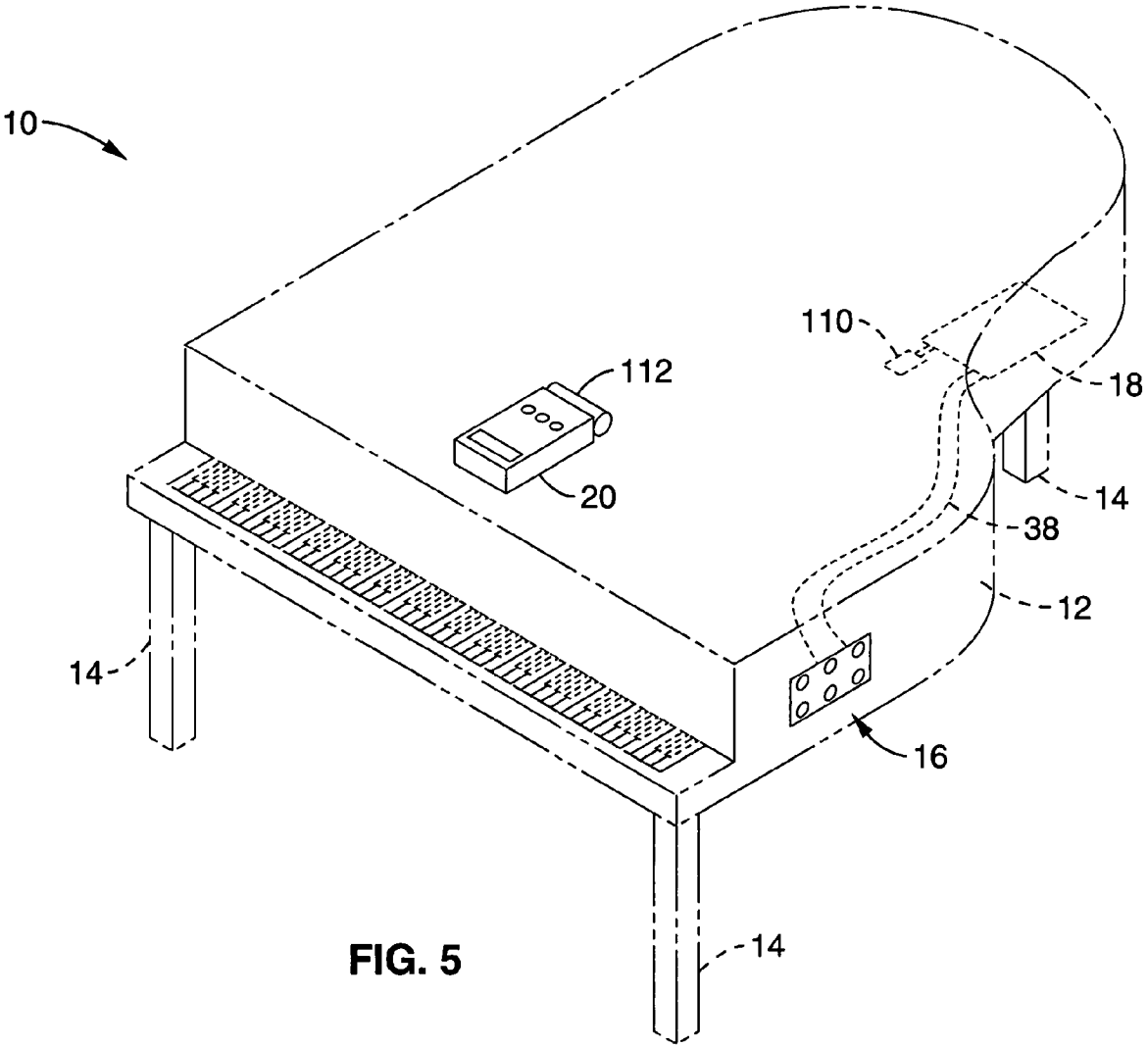
FIG. 5 illustrates a portable media player interfacing with a PID via a wireless connection in accordance with the present invention.

As an alternative to, or in combination with the wired configuration shown in FIG. 1, the PID may be equipped with an FM receiver as shown in FIG. 5 to achieve wireless data transmission. In this configuration, the PID 18 is coupled to an FM receiver 110 that can be programmed to an unused band on the FM dial (within FCC limits). The media player 20 may be coupled to an FM transmitter 112 (such as Itrip™ by Griffin Technologies). Other remote transmission means, such as RF or IR, may also be implemented.

Although the description above contains many details, these should not be construed as limiting the scope of the invention but as merely providing illustrations of some of the presently preferred embodiments of this invention. For example, the above description is directed primarily at use with a MIDI-compatible piano. However, the apparatus and methods of the present invention may be used with any MIDI-capable instrument or device. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An interface apparatus for communicating between a media player and a MIDI-compatible instrument, comprising:

a demodulator;

wherein said demodulator is configured to demodulate a MIDI data stream from an audio signal received from a media player;

a signal monitor configured to measure the amplitude of at least a portion of the audio signal; and a processor configured to control a MIDI volume level of the instrument by adjusting or inserting MIDI codes within the MIDI data stream in response to the measured amplitude of the audio signal.

2. An apparatus as recited in claim 1, wherein the processor is configured to inject a MIDI command into the MIDI data stream to control the MIDI volume level.

3. An apparatus as recited in claim 2, wherein the MIDI command comprises a channel volume control message.

4. An apparatus as recited in claim 2, wherein the MIDI command comprises a custom system exclusive message.

5. An apparatus as recited in claim 1, wherein the processor is configured to adjust at least one MIDI velocity in the MIDI data stream by adjusting MIDI values in response to the measured amplitude of the audio signal.

6. An apparatus as recited in claim 5:

wherein the MIDI data stream comprises a plurality of MIDI messages; and wherein the processor is configured to modify the MIDI messages based on at least one stored parameter.

7. An apparatus as recited in claim 6:

wherein the MIDI-compatible instrument comprises an electronic piano drive system; and wherein the drive system is configured to play notes on a piano in response to the modified MIDI messages.

8. An apparatus as recited in claim 1, wherein the interface apparatus is configured to adjust note velocity of a player piano in response to the measured amplitude of the audio signal.

9. An apparatus as recited in claim 1, wherein the audio signal comprises:

a first channel having a modulated MIDI component; and a second channel having an audio component.

10. An apparatus as recited in claim 9, wherein the demodulator and the signal monitor operate on only the first channel.

11. An apparatus as recited in claim 10, wherein the signal monitor is configured to measure the analog amplitude of the modulated MIDI component.

12. An apparatus as recited in claim 11, wherein the signal monitor comprises a voltage comparator.

13. An apparatus as recited in claim 9:

wherein the second channel is coupled to a mono-to-pseudo stereo converter to separate the audio component into left and right channels; and wherein said audio component comprises audio accompaniment.

14. An apparatus as recited in claim 7:

wherein the media player comprises a portable media player with an audio volume control means for changing audio amplitude; and wherein the media player is configured to output the audio signal through a line out.

15. An apparatus as recited in claim 14, wherein the signal monitor is adapted to measure the signal strength from the media player, wherein an increase in the signal strength from the media player affects a corresponding increase in note velocity of the player piano.

16. A method of controlling a MIDI compatible instrument, comprising:

inputting an audio signal comprising a modulated MIDI data stream;

wherein changing the volume level of the audio signal being input changes the analog amplitude of the audio signal with its modulated MIDI data stream;

monitoring the audio signal to measure the analog amplitude of the MIDI data stream; and controlling a MIDI volume level of the instrument by adjusting or inserting MIDI codes within the MIDI data stream in response to the measured amplitude of the monitored audio signal.

17. A method as recited in claim 16:

wherein the audio signal being input is modulated; and wherein the method further comprises demodulating the modulated MIDI data stream.

18. A method as recited in claim 17, wherein controlling the MIDI volume comprises modifying the demodulated MIDI data stream in response to the measured amplitude of the modulated MIDI data stream.

19. A method as recited in claim 17, wherein controlling the MIDI volume comprises injecting a MIDI command into the data stream in response to the measured amplitude of the modulated MIDI data stream.

20. A method as recited in claim 19, wherein the MIDI command comprises a channel volume control message.

21. A method as recited in claim 19, wherein the MIDI command comprises a custom system exclusive message.

22. A method as recited in claim 17, wherein the MIDI data stream is monitored and demodulated simultaneously.

23. A method as recited in claim 17:

wherein the MIDI data stream comprises a plurality of MIDI messages;

wherein at least one of the MIDI messages comprises a MIDI velocity message; and wherein the MIDI velocity is modified in response to the measured amplitude of the MIDI data stream.

24. A method as recited in claim 17, wherein inputting an audio signal comprises:

inputting an audio signal from a media player with an audio volume control means for changing audio amplitude.

25. A method as recited in claim 24, wherein inputting an audio signal from a media player comprises:

modulating MIDI data for audio playback;

loading the modulated MIDI data onto the media player; and playing the modulated MIDI data for output through a line out of the media player.

26. A method as recited in claim 25, further comprising compressing the modulated MIDI data prior to modulation.

27. A method as recited in claim 26, wherein the modulated MIDI data is compressed as an mp3 file.

28. A method as recited in claim 25, wherein loading the modulated MIDI data comprises:

loading a media on to the media player;

said media containing the modulated MIDI data.

29. A method as recited in claim 27:

wherein loading the modulated MIDI data comprises loading the mp3 file on to a mp3 player; and wherein playing the modulated MIDI data comprises decompressing the MP3 file for playback through the line out.

30. A method as recited in claim 23, wherein at least a portion of the plurality of MIDI messages are modified in response to at least one stored parameter.

31. A method as recited in claim 23, further comprising:

controlling a MIDI-compatible instrument in response to the modified MIDI messages.

32. A method as recited in claim 31, further comprising:

controlling note velocity of the MIDI-compatible instrument in response to the modified MIDI velocity.

33. A method as recited in claim 31:

wherein the MIDI-compatible instrument comprises an electronic piano drive system; and further comprising playing notes on a piano in response to the modified MIDI messages.

34. A method as recited in claim 24, further comprising:

increasing the volume on the media player to increase the amplitude of the MIDI data stream.

35. A method as recited in claim 17, wherein the inputted audio signal comprises:

a first channel having a modulated MIDI component; and a second channel having an audio component;

wherein only the first channel is demodulated and monitored.

36. A method as recited in claim 35, further comprising:

converting the audio component from mono-to-pseudo stereo; and separating the audio component into left and right channels.

37. A method as recited in claim 36:

wherein said audio component comprises audio accompaniment; and further comprising outputting said audio accompaniment to at least one speaker.

38. An apparatus for modulating note velocity within an electronic player piano in response to received analog signal amplitude, comprising:

means for demodulating an audio signal to extract a MIDI data stream;

means for monitoring the audio signal to measure the analog signal amplitude of at least a portion of the audio signal; and means for adjusting playback note velocity of the player piano by adjusting or inserting MIDI values within the MIDI data stream in response to the analog signal amplitude of the received audio signal.

39. An apparatus as recited in claim 38, further comprising:

means for actuating the keys of a player piano mechanism in response to said extracted MIDI data stream.

40. An apparatus as recited in claim 39:

wherein the MIDI data stream comprises a plurality of MIDI messages; and wherein the apparatus further comprises:

means for storing one or more system parameters; and means for modifying at least one of the plurality of MIDI messages in response to one of the stored system parameters.

41. An apparatus as recited in claim 38, further comprising:

means for storing one or more system parameters; and means for injecting a MIDI volume control command in response to one of the stored system parameters.

42. An apparatus as recited in claim 41, further comprising means for controlling the analog signal amplitude of the audio signal.

43. An apparatus as recited in claim 38:

a media player having a volume control means for controlling the analog signal amplitude of the audio signal; and wherein adjustment of the volume control adjusts the analog amplitude of the received audio signal.

44. An apparatus as recited in claim 43, further comprising means for modulating the MIDI data stream prior to playback on said media player.

45. An apparatus as recited in claim 43, further comprising means for compressing the MIDI data stream prior to playback on said media player.

46. An apparatus as recited in claim 38:

wherein the audio signal comprises a MIDI channel and an audio channel; and wherein said demodulating means and said monitoring means only operate on the MIDI channel.

47. An apparatus as recited in claim 46, further comprising a means for converting said audio channel from mono to pseudo-stereo for output to at least one speaker.

* * * * *